US006802561B2

(12) United States Patent
Ware et al.

(10) Patent No.: US 6,802,561 B2
(45) Date of Patent: Oct. 12, 2004

(54) BENCH ASSEMBLY

(75) Inventors: Harold L. Ware, 1475 Lakehurst, Ada, OK (US) 74820; Mark L. Sherwood, Richardson, TX (US)

(73) Assignee: Harold L. Ware, Ada, OK (US)

( * ) Notice: Subject to any disclaimer, the term of this patent is extended or adjusted under 35 U.S.C. 154(b) by 0 days.

(21) Appl. No.: 10/361,974

(22) Filed: Feb. 10, 2003

(65) Prior Publication Data

US 2003/0160484 A1 Aug. 28, 2003

Related U.S. Application Data

(60) Provisional application No. 60/355,778, filed on Feb. 8, 2002.

(51) Int. Cl.[7] ..... A47C 13/00; A47C 15/00

(52) U.S. Cl. ..... 297/104; 297/244; 297/245; 297/257

(58) Field of Search ..... 297/94, 104, 248, 297/244, 245, 257

(56) References Cited

U.S. PATENT DOCUMENTS

| | | | | | |
|---|---|---|---|---|---|
| 363,661 | A | * | 5/1887 | McKelvey et al. | 297/104 X |
| 365,025 | A | * | 6/1887 | Scarritt et al. | 297/104 X |
| 443,301 | A | * | 12/1890 | Stienen | 297/244 |
| 587,022 | A | * | 7/1897 | Thomas | 297/257 |
| 1,157,458 | A | | 10/1915 | Thompson | |
| 1,241,951 | A | * | 10/1917 | Fremaux | 297/244 X |
| 2,665,744 | A | | 1/1954 | Hodgson | |
| 5,749,623 | A | | 5/1998 | Mistry et al. | |
| 6,331,033 | B2 | * | 12/2001 | Lau | 297/325 |

* cited by examiner

*Primary Examiner*—Anthony D. Barfield
(74) *Attorney, Agent, or Firm*—Dunlap, Codding & Rogers, P.C.

(57) ABSTRACT

A bench assembly is provided which includes a seat assembly and at least two backrest assemblies. The back assemblies are rotatable from one side of the seat assembly to an opposite side independently of one another such that persons sitting on the seat assembly can be facing in the same direction or in opposite directions.

10 Claims, 7 Drawing Sheets

BENCH ASSEMBLY

CROSS REFERENCE TO RELATED APPLICATIONS

This application claims the benefit under 35 U.S.C. 119(e) of U.S. Provisional application No. 60/355,778 filed Feb. 8, 2002.

BACKGROUND OF THE INVENTION

Benches typically have a seat portion sized to accommodate two or more persons and a back rest fixed to the seat portion. As such, each person sitting on the bench is forced to face in the same direction. This is not a problem if each person sitting on the bench desires to face the same direction, which is often the case when viewing scenery or a particular activity. However, there are times when individuals desire to sit on a bench for the purpose of relaxing and having a conversation with another person sitting on the bench. In this regard, it is uncomfortable for two persons who are sitting side by side and facing the same direction to carry on a conversation. To look at one another, each person must turn his head or twist his body toward the other person. Repeating these motions over a period of time can be extremely uncomfortable.

Thus, a need exists for a bench assembly which allows each person sitting on the bench assembly to sit facing the same direction or to sit facing in opposite directions, thereby facing one another. It is to such a bench assembly that the present invention is directed.

DETAILED DESCRIPTION OF THE INVENTION

The term "bench assembly" as used herein is to be understood to include self-standing bench structures, gliders, swings and other devices having a seat and a back rest upon which people sit.

Figure 1:
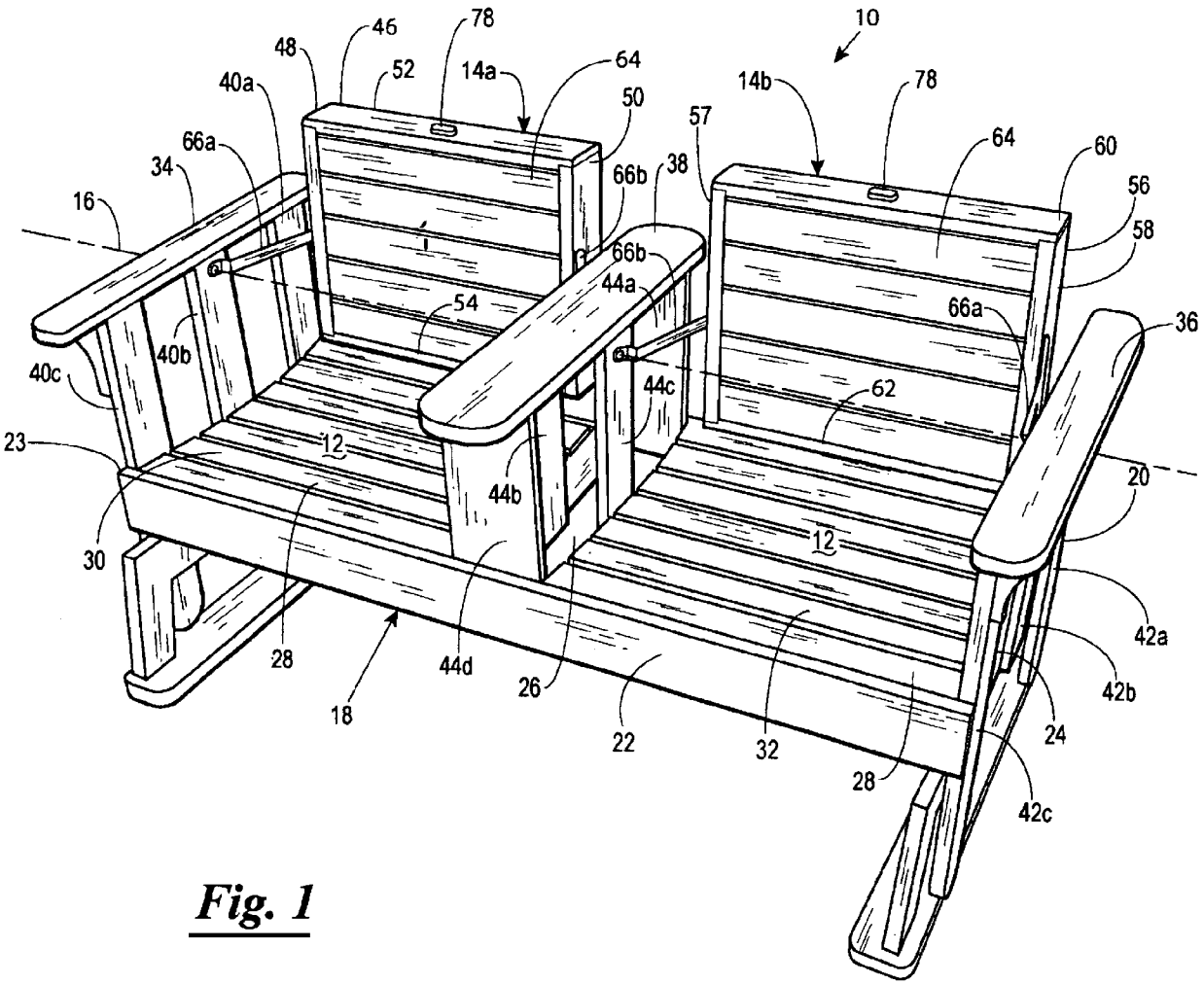
FIG. 1 is a perspective view of a bench assembly constructed in accordance with the present invention having two back rest assemblies shown facing in the same direction.
Figure 2:
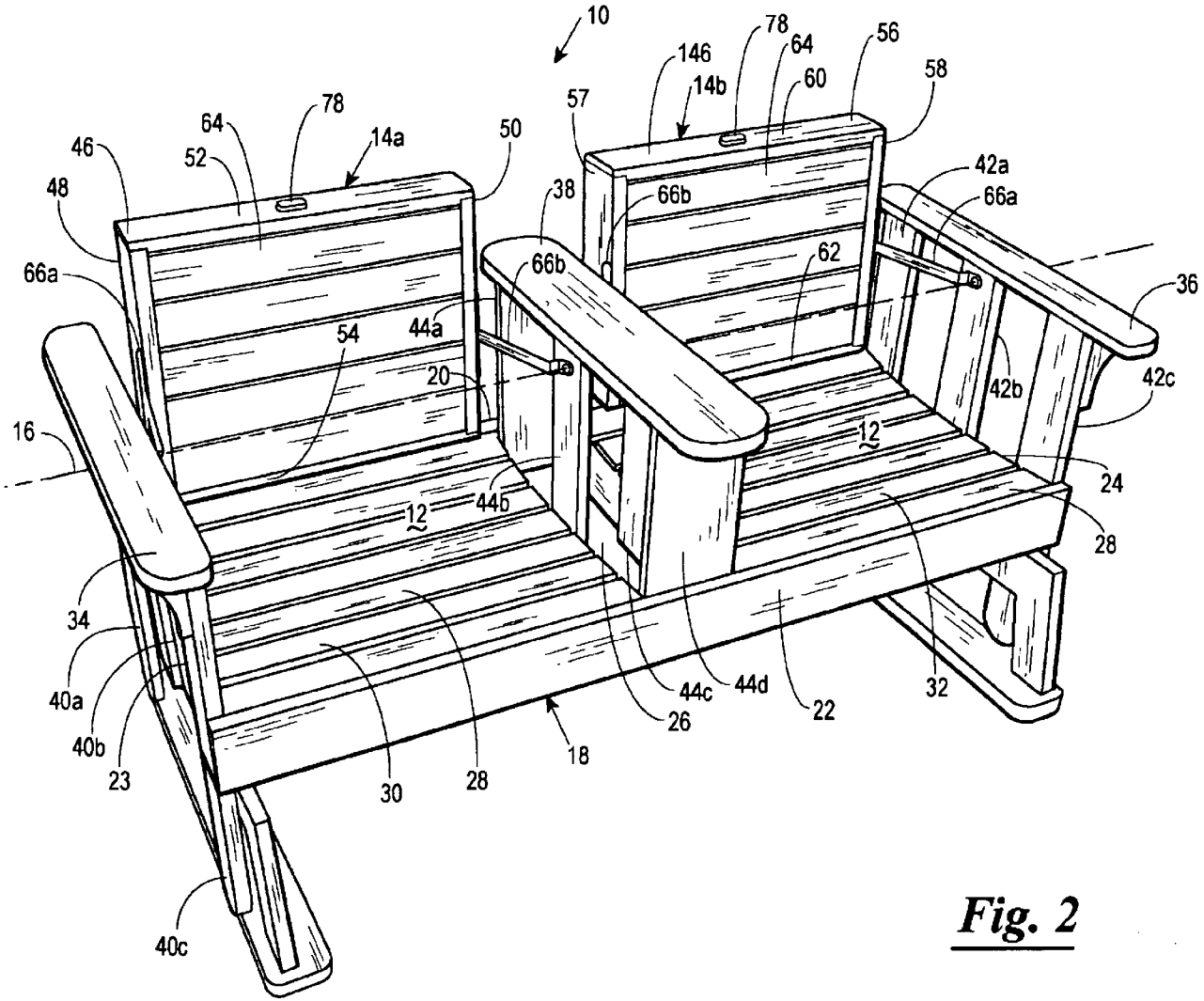
FIG. 2 is another perspective view of the bench assembly of FIG. 1.

Referring now to the drawings, and more particularly to FIGS. 1 and 2, a bench assembly 10 constructed in accordance with the present invention is illustrated. The bench assembly 10 includes a seat assembly 12 and a pair of back rest assemblies 14*a* and 14*b* which are selectively rotatable about a center line 16 so as to be positionable on either side of the seat assembly 12.

The seat assembly 12 includes a seat frame 18 which is characterized as having a first side 20, a second side 22, a first end 23, and a second end 24. The seat frame 18 is further provided with a central slot 26 extending generally from the first side 20 to the second side 22.

The seat assembly 12 has a plurality of slats 28 secured across the seat frame 18 so as to form a first sitting area 30 and a second sitting area 32. The first sitting area 30 is generally defined as extending between the first side 20 and the second side 22 and between the first end 23 and the central slot 26. Similarly, the second sitting area 32 is generally defined as extending between the first side 20 and the second side 22 and between the second end 24 and the central slot 26.

The seat assembly 12 is further provided with a pair of outer arm rests 34 and 36 and a central arm rest 38. The outer arm rest 34 is connected to the first end 23 of the seat frame 18 by a plurality of vertical support members 40*a*, 40*b*, and 40*c* with the vertical support member 40*b* being positioned so as to be aligned with the center line 16. Likewise, the outer arm rest 36 is connected to the second end 24 of the seat frame 18 by a plurality of vertical support members 42*a*, 42*b*, and 42*c* with the vertical support member 42*b* positioned so as to be aligned with the center line 16. Finally, the central arm rest 38 is connected to the seat frame 18 by a plurality of vertical support members 44*a*–44*d* which are secured to the seat frame 18 within the central slot 26. The vertical support members 44*b* and 44*c* are secured to the seat frame 18 in alignment with the center line 16, but on opposite sides of the central slot 26.

As shown in FIGS. 1 and 2, the back rest assembly 14*a* includes a back frame 46 having a first side 48, a second side 50, a first end 52, and a second end 54. Likewise, the back rest assembly 14*b* has a back frame 56 having a first side 57, a second side 58, a first end 60, and a second end 62. Each of the back rest assemblies 14*a* and 14*b* further include a plurality of slats 64 secured across the back frame 46 and the back frame 56.

Figure 3:
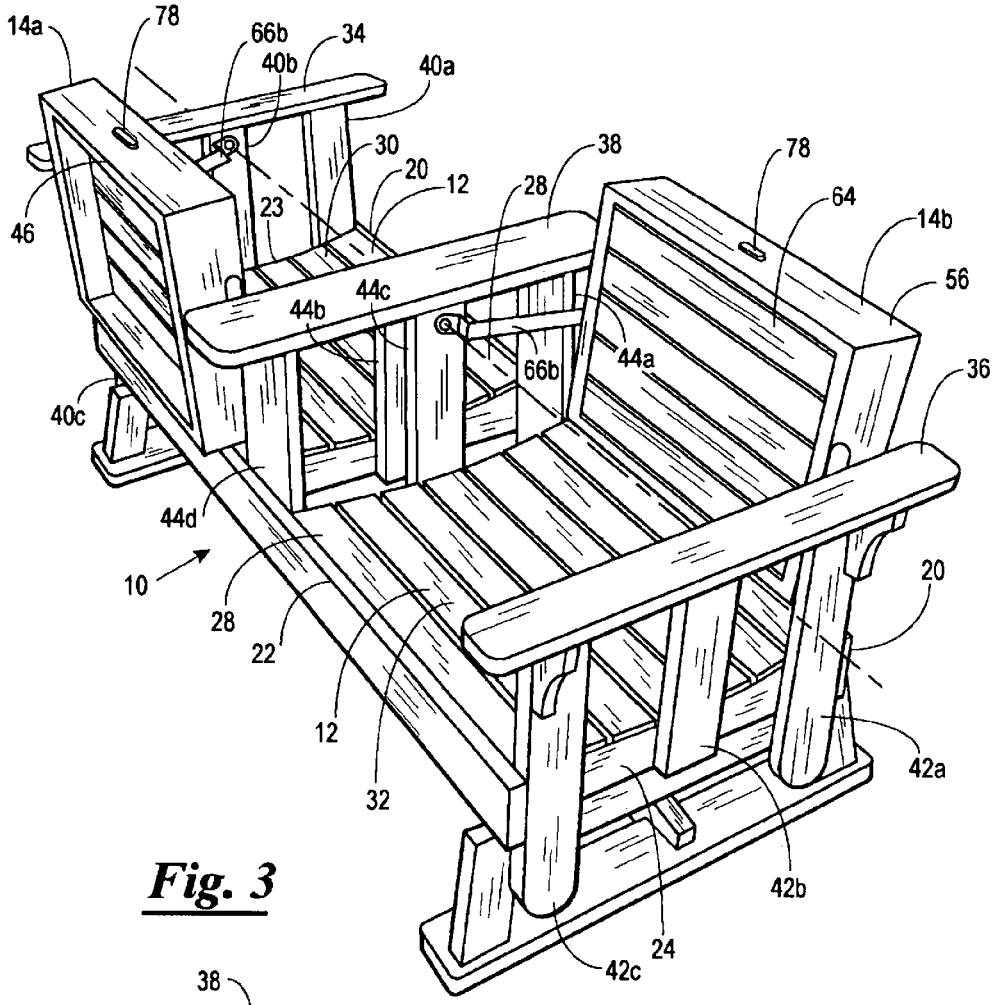
FIG. 3 is a perspective view of the bench assembly of FIG. 1 showing the back rest assemblies facing in opposite directions.

Each of the back rest assemblies 14*a* and 14*b* is connected to the seat assembly 12 so as to be rotatable about the center line 16 from the first side 20 of the seat frame 18 to the second side 22 of the seat frame 18 thereby allowing the back rest assemblies 14*a* and 14*b* to be positioned facing the same direction, as shown in FIGS. 1 and 2, or positioned facing in opposite directions, as shown in FIG. 3.

Figure 4:
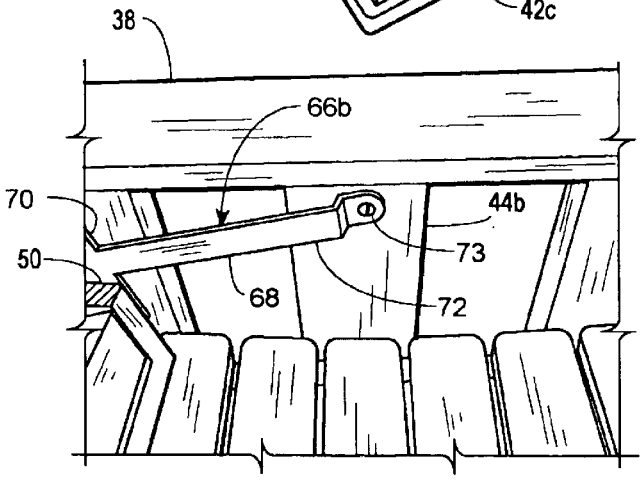
FIG. 4 is an enlarged, perspective view of a hinge assembly used in the present invention.

Each back rest assembly 14*a* and 14*b* is connected to the seat assembly 12 with a pair of hinge assemblies 66*a* and 66*b*. As best shown in FIG. 4, the hinge assembly 66*b* includes a T-shaped arm 68 having a first portion 70 and second portion 72 extending from the first portion 70 in a substantially perpendicular relationship. The second portion 72 is provided with a distal end 73 which is offset relative to the first portion 70 to facilitate rotation of the back rest assemblies 14*a* and 14*b* relative to the seat assembly 12. The hinge assembly 66*a* is a mirror image of the hinge assembly 66*b*.

The back rest assembly 14*a* is mounted to the seat assembly 12 to correspond to the first sitting area 30 and the back rest assembly 14*b* is mounted to the seat assembly 12 to correspond to the second sitting area 32. To assemble the back rest assembly 14*a* to the seat assembly 12, the first portion 70 of the hinge assembly 66*b* is mounted to the second side 50 of the back frame 46 such that the second portion 72 of the hinge assembly 66*a* extends substantially perpendicularly from the back frame 46 from a position which is substantially an equal distance from the first end 52 and the second end 54 of the back frame 46. The distal end 73 of the second portion 72 is then pivotally attached to the vertical support member 44*b* at a point that intersects the center line 16.

Similarly, the hinge assembly 66*a* is attached to the first side 48 of the back frame 46 and the distal end 73 of the second portion 72 is pivotally connected to the vertical support member 40*b* at a point that intersects the center line 16. The back rest assembly 14*b* is attached to the seat assembly 12 with a pair of the hinge assemblies 66*a* and 66*b* so as to correspond with the second sitting area 32 in an identical manner.

The distal end 73 of the hinge assembly 66*a* and 66*b* are pivotally attached to their respective vertical support members so as to provide a pivot point with is substantially centered between the first side 20 and the second side 22 of the seat frame 18 whereby the back rest assemblies 14*a* and 14*b* rotate about the center line 16 of the seat assembly 12 in a symmetrical fashion. It will be appreciated that by varying the length of the second portion 72 of the hinge assemblies 66*a* and 66*b* and/or the position along the length of the vertical support member at which the distal end 73 is connected to the vertical support member, the angular relationship of the back rest assemblies 14*a* and 14*b* relative to the seat assembly 12 can be altered.

To cushion the back rest assemblies 14*a* and 14*b* when the back rest assemblies 14*a* and 14*b* are engaged against the seat assembly 12, a rubber stop member 78 is secured to each of the first and second ends 52 and 54 of the back frame 46 and to the first and second ends 60 and 62 of the back frame 56.

Figure 5:
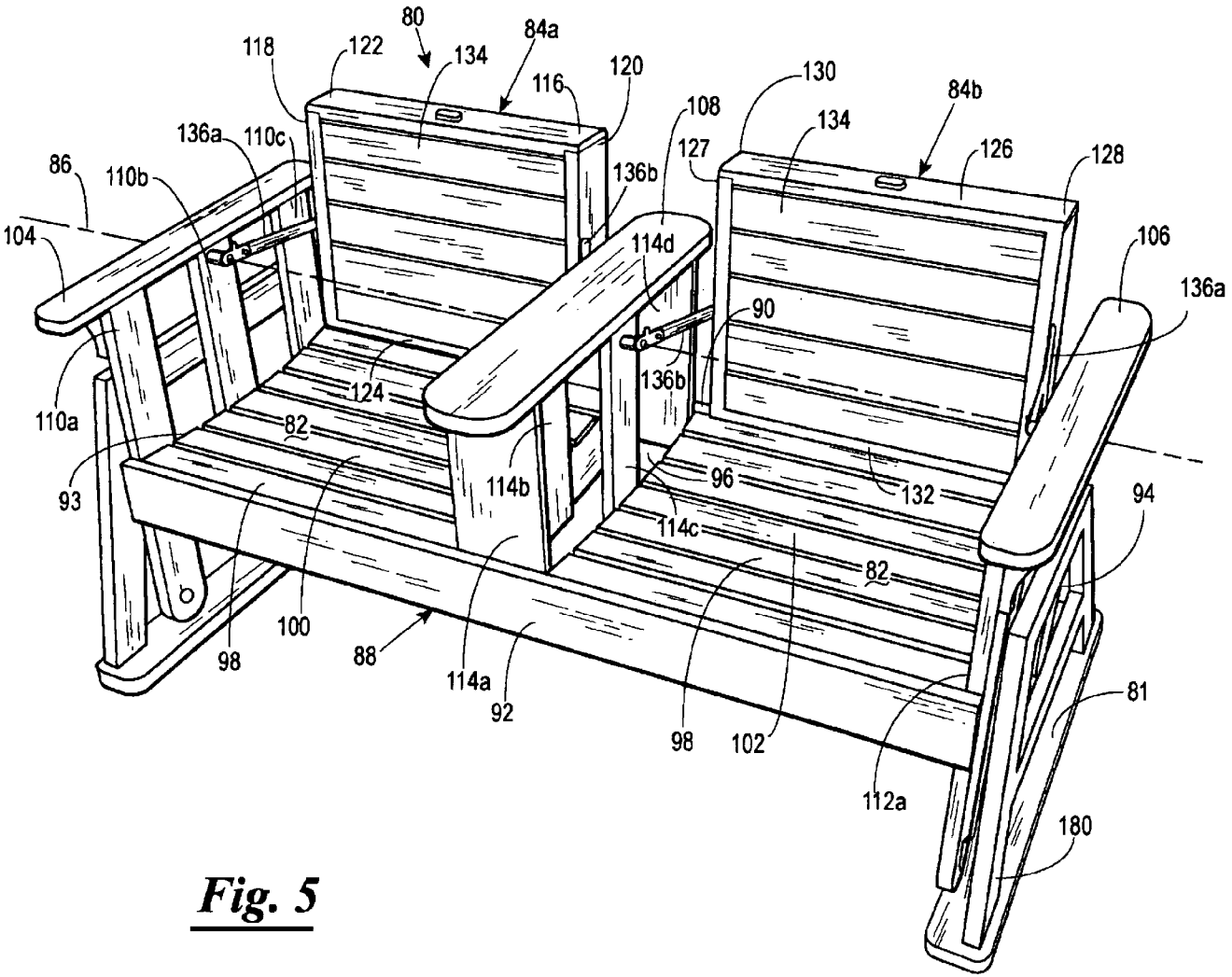
FIG. 5 is a perspective view of another embodiment of a bench assembly constructed in accordance with the present invention having two back rest assemblies shown facing in the same direction.
Figure 6:
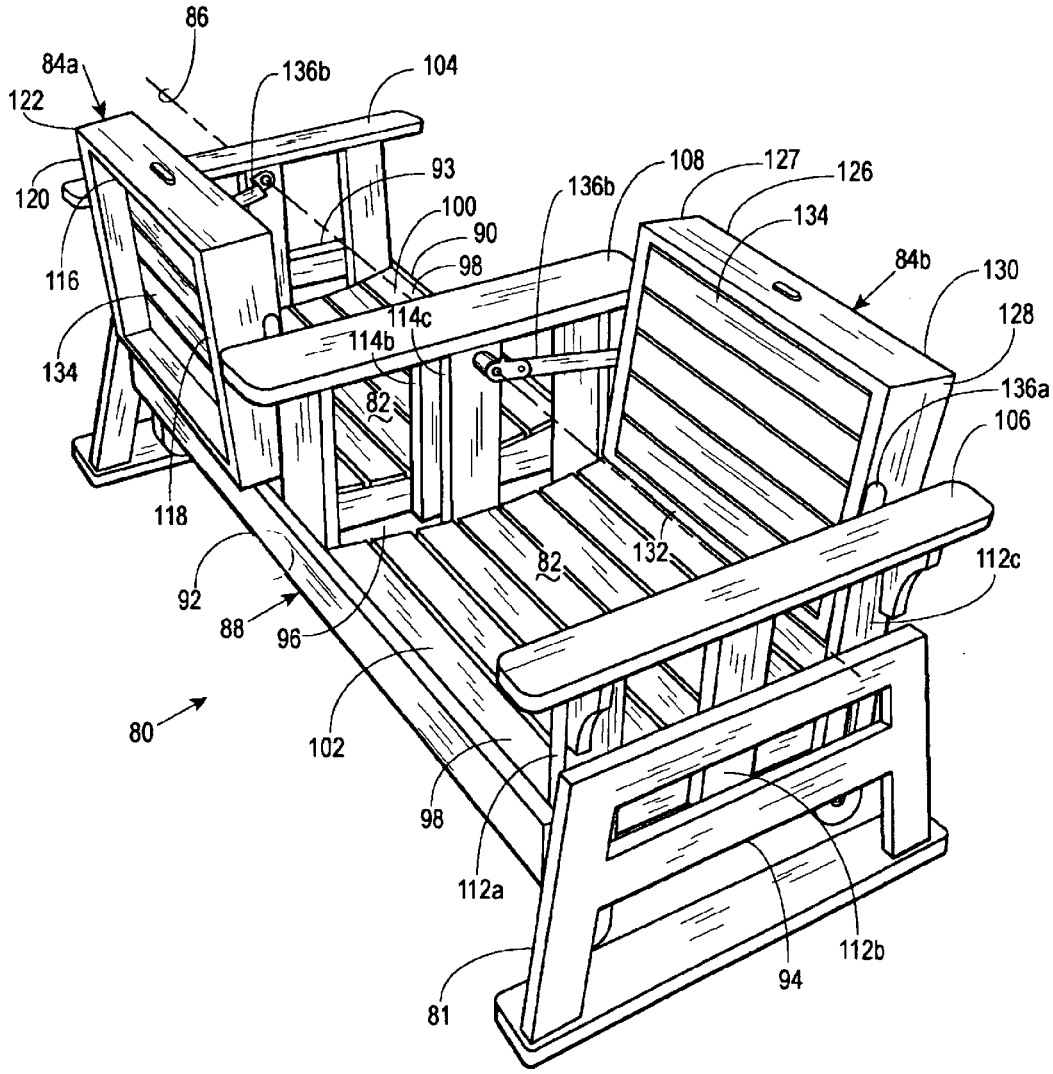
FIG. 6 is a perspective view of the bench assembly of FIG. 5 showing the back rest assemblies facing in opposite directions.

Referring now to FIGS. 5 and 6, another embodiment of a bench assembly 80 is shown. The bench assembly 80 is a glider and is similar to the bench assembly 10 herein before described except as described hereinafter. That is, the bench assembly 80 includes a seat assembly 82 and a pair of back rest assemblies 84*a* and 84*b* which are selectively positioned about a center line 86 so as to be positionable on either side of the seat assembly 82, are operably connected to a glider frame 81.

The seat assembly 82 includes a seat frame 88 which is characterized as having a first side 90, a second side 92, a first end 93, and a second end 94. The seat frame 88 is further provided with a central slot 96 extending generally from the first side 90 to the second side 92. The seat assembly 82 has a plurality of slats 98 secured across the seat frame 88 so as to form a first sitting area 100 and a second sitting area 102. The first sitting area 100 is generally defined as extending between the first side 90 and the second side 92 and between the first end 93 and the central slot 96. Similarly, the second sitting area 102 is generally defined as extending between the first side 90 and the second side 92 and between the second end 94 and the central slot 96.

The seat assembly 82 is further provided with a pair of outer arm rests 104 and 106 and a central arm rest 108. The outer arm rest 104 is connected to the first end 93 of the seat frame 88 by a plurality of vertical support members 110*a*, 110*b* and 119*c*. Likewise, the outer arm rest 106 is connected to the second end 94 of the seat frame 88 by a plurality of vertical support members 112*a*, 112*b* and 112*c*. Finally, the central arm rest 108 is connected to the seat frame 88 by a plurality of vertical support members 114*a*–114*d* which are secured to the seat frame 88 within the central slot 96. The vertical support members 114*b* and 114*c* are secured to the seat frame 88 in alignment with the center line 86, but on opposite sides of the central slot 96.

The back rest assembly 84*a* includes a back frame 116 having a first side 118, a second side 120, a first end 122, and a second end 124. Likewise, the back rest assembly 84*b* has a back frame 126 having a first side 127, a second side 128, a first end 130, and a second end 132. Each of the back rest assemblies 84*a* and 84*b* further include a plurality of horizontally disposed slats 134 secured across the back frame 116 and the back frame 126.

Each of the back rest assemblies 84*a* and 84*b* is connected to the seat assembly 82 so as to be positioned about the center line 86 from the first side 90 of the seat frame 88 to the second side 92 of the seat frame 88 thereby allowing the back rest assemblies 84*a* and 84*b* to be positioned facing the same direction, as shown in FIG. 5, or positioned facing in opposite directions, as shown in FIG. 6.

Each of the back rest assemblies 84*a* and 84*b* is connected to the seat assembly 82 with a pair of hinge assemblies 136*a* and 136*b*. The hinge assemblies 136*a* and 136*b* are mirror images of one another. Thus, for the sake of brevity, only the hinge assembly 136*a* will be described in detail.

Figure 7:
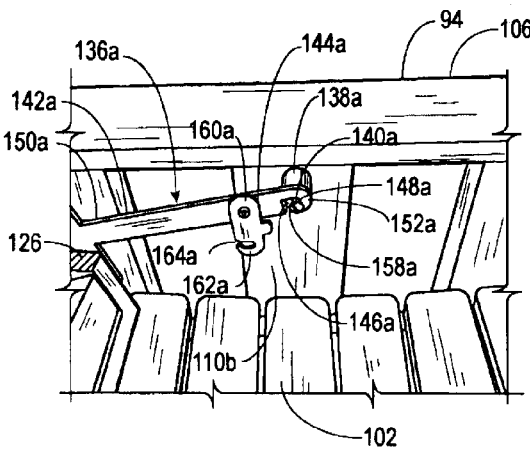
FIG. 7 is an enlarged, perspective view of another embodiment of a hinge assembly in an unlocked position used in the present invention.
Figure 8:
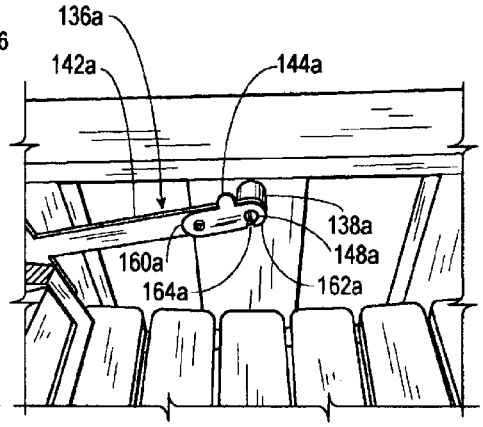
FIG. 8 is another view of the hinge assembly of FIG. 7 shown in a locked position.

As best shown in FIGS. 7 and 8, the hinge assembly 136*a* includes a spacer 138*a*, a pin 140*a*, an arm 142*a*, and a latching member 144*a*. The spacer 138*a* is attached to the outer arm rest 106 in alignment with the center line 86 (FIG. 5). The pin 140*a*, which has a shaft portion 146*a* and a head portion 148*a*, extends from the spacer 138*a* such that the head portion 148*a* and an end of the spacer 138*a* cooperate to form a recess (not shown). One end of the arm 142*a* is attached to the second side 128 of the back frame 126 of the back rest assembly 84*b* such that the arm 142*a* extends substantially perpendicularly from the back frame 126. Further, the arm 142*a* extends from the back frame 126 at a location near the second end 132 of the back frame 126. As such, the arm 142*a* remains positioned below the outer arm rest 106 so as not to interfere with use of the outer arm rest 106. The opposing end of the arm 142*a* is provided with a hook portion 158*a*. The hook portion 158*a* of the arm 142*a* is sized and dimensioned to be received in the recess and engage the shaft portion 146*a* of the pin 140*a*.

The latching member 144*a* has a first end 160*a* and a second end 162*a*. The first end 160*a* of the latching member 144*a* is pivotally attached to the arm 142*a*, and the second end 162*a* of the latching member 144*a* is provided with a notch 164*a* sized and dimensioned to receive the shaft portion 146*a* of the pin 140*a*.

As shown in FIGS. 5 and 7, the back rest assembly 84*a* is mounted to the seat assembly 82 to correspond to the first sitting area 100 and the back rest assembly 84*b* is mounted to the seat assembly 82 to correspond to the second sitting area 102. To secure the back rest assembly 84*b* to the seat assembly 82, the hook portion 158*a* of the arm 142*a* is positioned on the shaft portion 146*a* of the pin 140*a* so as to hold the arm 142*a* between the head portion 148*a* of the pin 140*a* and the spacer 138*a*. The latching member 144*a* is rotated until the second end 162*a* of the latching member 144*a* is positioned between the head portion 148*a* of the pin 140*a* and the arm 142*a* with the shaft portion 146*a* received in the notch 164*a* of the latching member 144*a* so as to lock the arm 142*a* in the recess.

Similarly, the hinge assembly 136*b* is locked in position relative to the central arm rest 108, in a manner similar to that discussed above for the hinge assembly 136*a,* thereby causing the back rest assembly 84*b* to be secured and supported.

The back rest assembly 84*a* is attached to the seat assembly 82 with a pair of the hinge assemblies 136*a* and 136*b* so as to correspond with the first sitting area 100 in an identical manner. The hinge assemblies 136*a* and 136*b* function in an identical manner as described above, except that the hinge assembly 136*a* is attached to the first side 118 of the back frame 116 and the hinge assembly 136*b* is attached to the second side 120 of the back frame 116.

As mentioned above and as shown in FIG. 6, the back rest assemblies 84*a* and 84*b* may be positioned facing opposite directions. Each of the back rest assemblies 84*a* and 84*b* may be removed from its position when facing the same direction to face a direction opposite the other. For example, to remove the back rest assembly 84*a,* the latching member 144*a* of the hinge assembly 136*a* is rotated to an unlocked position wherein the latching member 144*a* is disengaged from the shaft portion 146*a* of the pin 140*a*. Similarly, the latching member 144*b* of the hinge assembly 136*b* is rotated to an unlocked position wherein the latching member 144*b* is disengaged from the shaft portion 146*b* of the pin 140*b*. An individual may then move the back rest assembly 84*a* inwardly so that the hook portion 158*a* of the arm 142*a* disengages from the shaft 148*a* of the pin 140*a* and the hook portion 158*b* of the arm 142*b* disengages from the shaft portion 146*b* of the pin 140*b*, respectively. The back rest assembly 84*a* may then be lifted and removed from the first side 90 of the seat frame 88 and positioned on the second side 92 of the seat frame 88 to face in the opposite direction of the back rest assembly 84*b*.

To secure the back rest assembly 84*a* to the second side 92 of the seat frame 88, the arm 142*b* of the hinge assembly 136*b* is positioned so that the hook portion 158*b* of the arm 142*b* is positioned to engage the shaft portion 146*a* of the pin 140*a* so as to hold the arm 142*b* between the head portion 148*a* of the pin 140*a* and the spacer 138*a*. Likewise, the arm 142*a* of the hinge assembly 136*a* is positioned so that the hook portion 158*a* of the arm 142*a* is positioned to engage the shaft portion 146*b* of the pin 140*b* so as to hold the arm 142*a* between the head portion 148*b* of the pin 140*b* and the spacer 138*b*. Finally, each of the latching members 144*a* and 144*b* are rotated to the locked position thereby securing the back rest assembly 84*a* to the second side 92 of the seat frame 88.

Figure 9:
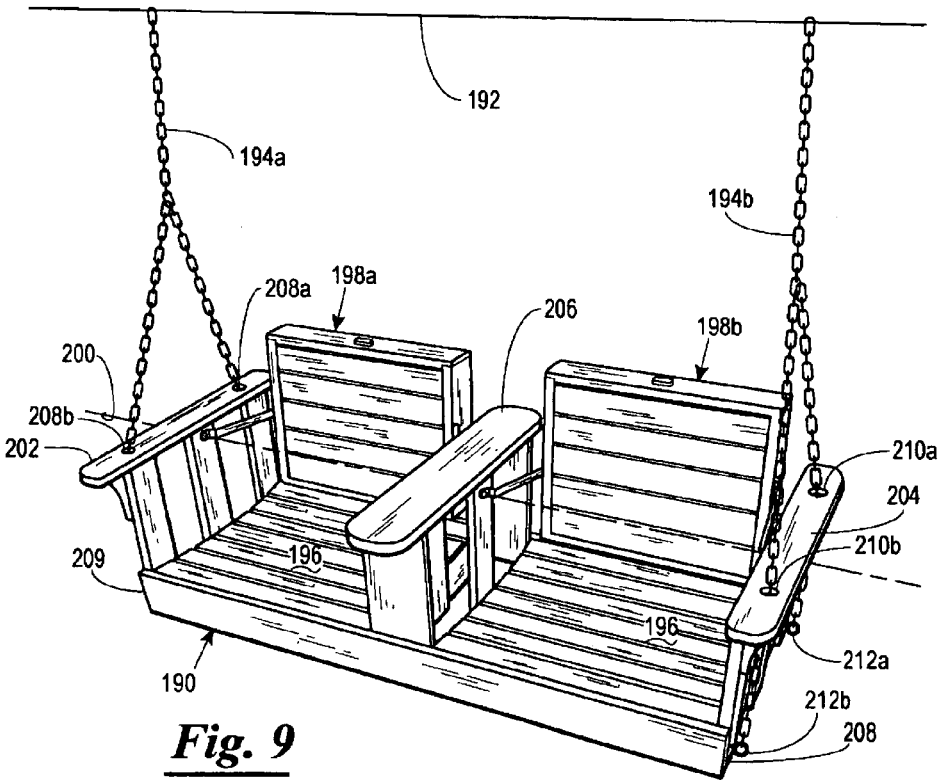
FIG. 9 is a perspective view of another embodiment of a bench assembly constructed in accordance with the present invention.

Referring now to FIG. 9, another embodiment of a bench assembly 190 is shown. The bench assembly 190 is a swing suspended from a support structure 192 by chain suspension members 194*a* and 194*b*. The bench assembly 190 is similar in construction to the bench assemblies 10 and 80 in that the bench assembly 190 includes a seat assembly 196 and a pair of back rest assemblies 198*a* and 198*b* which are selectively rotatable about a center line 200 so as to be positionable on either side of the seat assembly 196, outer arm rests 202 and 204 and an inner arm rest 206. The chain suspension member 194*a* extends through openings 208*a* and 208*b* in the outer arm rest 202 and is connected to a lower frame portion 209 of the bench assembly 190 in a conventional manner, such as with screw eyes (not shown).

Similarly, the chain suspension member 194*b* extends through openings 210*a* and 210*b* in the outer arm rest 204 and is connected to the lower frame portion 208 of the bench assembly 190 in a conventional manner, such as with screw eyes 212*a* and 212*b,* so that the suspension members 194*a* and 194*b* be are disposed on opposite sides of the bench assembly 190 whereby the bench assembly 190 is maintained in a suspended, balanced position substantially as shown.

Figure 10:
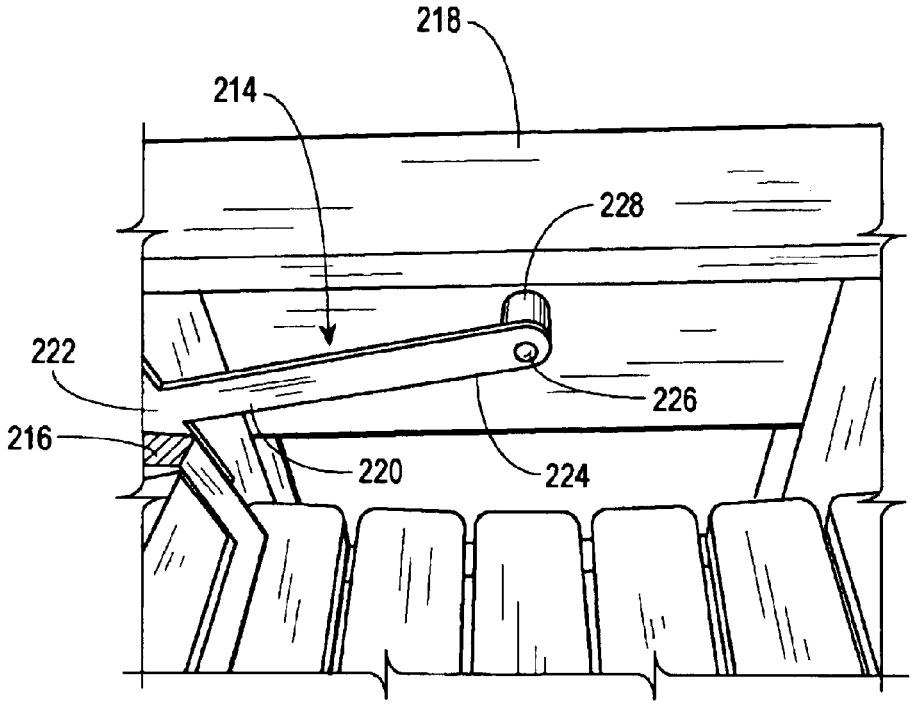
FIG. 10 is an enlarged, perspective view of another embodiment of a hinge assembly of the bench assemblies constructed in accordance with the present invention.

Referring now to FIG. 10 shown therein is another embodiment of a hinge assembly 214 which can be used in the construction of the bench assemblies of the present invention. The hinge assembly 214 is shown attached to a portion of a back rest assembly 216 and an outer arm rest 218 which are similar to the back rest assemblies and the outer arm rests of the bench assemblies 10, 80 and 190 herein before described. In this embodiment, the hinge assembly 214 includes a T-shaped arm 220 having a first portion 222 and a second portion 224 extending from the first portion 222 in a substantially perpendicular relationship.

The first portion 222 of the arm 220 is connected to the backrest assembly 216 and the second end portion 224 of the arm 220 is pivotally connected to the outer arm rest 218 via a pivot pin 226 and a spacer 228 so that the backrest assembly 216 can selectively rotated between a first and a second position, as described above for the other embodiments of the bench assemblies.

From the above, it can be seen that the bench assemblies are versatile and allow a person to quickly and easily change the direction that one or more backrest assemblies are facing. This feature accommodates the desires of the those sitting on the bench assembly by merely rotating the backrest assemblies from one side of the seat assembly to the other side of the seat assembly.

It will also be appreciated that the components of the bench assemblies 10, 80 and 190 described above, including their respective hinge assemblies can be constructed from any suitable rigid, durable material, such as wood, plastic, metal and the like, and the components may be fastened to one another with any suitable fasteners, including screws, nails, bolts, brackets, glue, and combinations thereof. It will also be appreciated that while the bench assemblies 10, 80 and 190 have been illustrated has having two sitting areas, the bench assemblies of the present invention can be constructed to have any number of sitting areas.

From the above description, it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and claimed.

What is claimed:

1. A bench assembly, comprising:

a seat assembly comprising;

a seat frame having a first side, a second side, a first end and a second end;

a plurality of seats supported by the seat frame for defining at least a first seating area and a second seating area, the first seating area spatially disposed from the second seating area so that a slot is provided there between, each of the first and second seating areas adapted to receive and support a person's posterior and upper legs when the person is in a sitting position on the first or second seating areas;

a first arm rest connected to the first end of the seat frame so as to extend upwardly from the first seating area;

a second arm rest connected to the second end of the seat frame so as to extend upwardly from the second seating area;

a central arm rest disposed in the slot and connected to the seat frame such that the central arm rest extends upwardly between the first and second seating areas;

a first back rest assembly;

a second back rest assembly; and means for pivotally connecting the first back rest assembly to the first arm rest and the center arm rest and for pivotally connecting the second back rest assembly to the second arm rest and the center arm rest such that the first back rest assembly extends substantially upward from the first seat assembly, and the second back rest assembly extends substantially upward from the second seat assembly the first back rest assembly being rotatable above the first seating area and about a center line of the seat frame from the first side of the seat frame to the second side of the seat frame whereby, when the first back rest assembly is disposed on the first end of the seat frame, the second end of the first back rest assembly engages the first side of the seat frame and when the first back rest assembly is disposed on the second side of the seat frame the first end of the first back assembly engages the second side of the seat frame, the second back rest assembly being rotatable above the second seating area and about the center line of the seat frame from the first side of the seat frame to the second side of the seat frame whereby, when the second back rest assembly is disposed on the first side of the seat frame, the second end of the second back rest assembly engages the first end of the seat frame and when the second back rest assembly is disposed on the second side of the seat frame the first end of the second back rest assembly engages the second side of the seat frame, the first and second back rest assemblies being rotatable independent of one another so that the first and second back rests can be positioned facing the same direction or facing opposite directions.

2. The bench assembly of claim 1 wherein each back rest assembly comprises a frame and a plurality of slats.

3. The bench assembly of claim 1 wherein the bench assembly is suspended from a support member by suspension members such that the bench assembly operates as a swing.

4. The bench assembly of claim 1 wherein the bench assembly is supported on a glider frame such that the bench assembly operates as a glider.

5. A bench assembly, comprising:

a seat assembly comprising;

a seat frame having a first side, a second side, a first end and a second end;

a plurality of seats supported by the seat frame for defining at least a first seating area and a second seating area, the first seating area spatially disposed from the second seating area so that a slot is provided there between, each of the first and second seating areas adapted to receive and support a person's posterior and upper legs when the person is in a sitting position on the first or second seating areas;

a first arm rest connected to the first end of the seat frame so as to extend upwardly from the first seating area;

a second arm rest connected to the second end of the seat frame so as to extend upwardly from the second seating area;

a central arm rest disposed in the slot and connected to the seat frame such that the central arm rest extends upwardly between the first and second seating areas;

a first back rest assembly and a second back rest assembly; and hinge means for pivotally connecting the first back rest assembly to the first arm rest and the center arm rest and for pivotally connecting the second back rest assembly to the second arm rest and the center arm rest such that the first back rest assembly extends substantially upward from the first seat assembly and is rotatable about a center line of the seat frame from the first side of the seat frame to the second side of the seat frame and the second back rest assembly extends substantially upward from the second seat assembly and is rotatable about the center line of the frame assembly independent of the rotation of the first back rest whereby the first and second back rests can be positioned facing the same direction or facing opposite directions, the hinge means comprising:

a plurality of substantially T-shaped arms, each of the arms having a first portion and a second portion, the second portion extending substantially perpendicularly to the first portion and having a distal end off set relative to the first portion for facilitating rotation of the first and second back rest assemblies relative to the first and second seating areas of the seat assembly.

6. The bench assembly of claim 5 wherein the hinge means further comprises a latching member that locks the distal end of the second portion of the T-shaped member in a locked position.

7. The bench assembly of claim 6 wherein the latching member is provided with a notch sized to receive a pivot pin, the latching member pivotally attached to the second portion of the arm near the distal end thereof, and wherein the latching member is moved to the locked in position by rotating the latching member so that the pivot pin is disposed in the notch of the latching member.

8. The bench assembly of claim 6 wherein the hinge means further comprises a spacer for enhancing rational movement of the first and second back rest assemblies relative to the seat assembly.

9. The bench assembly of claim 5 wherein the hinge means comprises a plurality of arm members, each of the arm members having a first portion and a second portion, the first portion of one of the arm members connected to the first side of the first back rest assembly and the second portion pivotally connected to the first arm rest, the first portion of second arm member connected to the second side of the first back rest assembly and the second end portion thereof pivotally connected to a first side of the central arm rest, the first portion of a third arm member connected to the first side of the second back rest assembly and the second portion thereof pivotally connected to a second side of the central arm rest, and the first end portion of a fourth arm member connected to the second side of the second back rest assembly and the second end portion thereof pivotally connected to the second arm rest.

10. A bench assembly, comprising:

a seat assembly comprising;

a seat frame having a first side, a second side, a first end and a second end;

a plurality of seats supported by the seat frame for defining at least a first seating area and a second seating area, the first seating area spatially disposed from the second seating area so that a slot is provided there between, each of the first and second seating areas adapted to receive and support a person's posterior and upper legs when the person is in a sitting position on the first or second seating areas;

a first arm rest connected to the first end of the seat frame so as to extend upwardly from the first seating area;

a second arm rest connected to the second end of the seat frame so as to extend upwardly from the second seating area;

a central arm rest disposed in the slot and connected to the seat frame such that the central arm rest extends upwardly between the first and second seating areas;

a first back rest assembly comprising a frame having a first side, a second side, a first end and a second end;

a second back rest assembly comprising a frame having a first side, a second side, a first and a second end; and wherein the first back rest assembly is pivotally connected to the first arm rest and the center arm rest such that the first back rest assembly extends substantially upward from the first seat assembly and the second back rest assembly is pivotally connected to the second arm rest and the center arm rest such that the second back rest assembly extends substantially upward from the second seat assembly, the first back rest assembly rotatable above the first seat assembly about a center line of the seat frame from the first side of the seat frame to the second side of the seat frame whereby, when the first back rest assembly is disposed on the first end of the seat frame, the second end of the frame of the first back rest assembly engages the first side of the seat frame and when the first back rest assembly is disposed on the second side of the seat frame the first end of the frame of the first back rest assembly engages the second side of the seat frame, and the second back rest assembly is rotatable above the second seat assembly about the center line of the seat frame independent of the rotation of the first back rest assembly whereby, when the second back rest assembly is disposed on the first side of the seat frame, the second end of the frame of the second back rest assembly engages the first side of the seat frame and, when the second back rest assembly is disposed on the second end of the seat frame, the first end of the frame of the second back rest assembly engages the second side of the seat frame.

* * * * *